US007210188B1

(12) United States Patent
Kirby

(10) Patent No.: US 7,210,188 B1
(45) Date of Patent: May 1, 2007

(54) GROUT CLEANING SPONGE

(76) Inventor: Mark E. Kirby, 2297 Jones Dr., Dunedin, FL (US) 34698

( * ) Notice: Subject to any disclaimer, the term of this patent is extended or adjusted under 35 U.S.C. 154(b) by 433 days.

(21) Appl. No.: 10/708,266

(22) Filed: Feb. 20, 2004

(51) Int. Cl.
*A47L 13/16* (2006.01)

(52) U.S. Cl. ..... 15/244.4; 15/244.1; D32/40

(58) Field of Classification Search ..... 15/244.1, 15/244.4; D32/40, 50–52
See application file for complete search history.

(56) References Cited

U.S. PATENT DOCUMENTS 2,946,154 A * 7/1960 Bornemann ..... 47/1.7
5,640,737 A * 6/1997 Boggs ..... 15/118
5,836,034 A * 11/1998 Galvan Garza ..... 15/118
6,076,221 A 6/2000 Bradshaw
D446,616 S * 8/2001 Denney ..... D32/40
D446,895 S * 8/2001 Denney ..... D32/40

* cited by examiner

*Primary Examiner*—Mark Spisich
(74) *Attorney, Agent, or Firm*—Ronald E. Smith; Smith & Hopen, P.A.

(57) ABSTRACT

A sponge for cleaning grout that occupies the concave spaces between tiles has a cleaning surface that includes a plurality of rows of elongate convexities. In a first embodiment, the convexities are linear in configuration, are disposed in parallel relation to one another, and the space between the convexities is flat. In a second embodiment, the space between the parallel, linear convexities is occupied by secondary convexities that have less height than the primary convexities. In a third embodiment, the convexities are non linear and non-parallel. In all embodiments, the convexities may be aligned with the concave grooves between tiles or positioned at a right angle to the grooves. In both orientations, the convexities extend into the concavities and clean the grout between the tiles.

1 Claim, 6 Drawing Sheets

FIG. 6
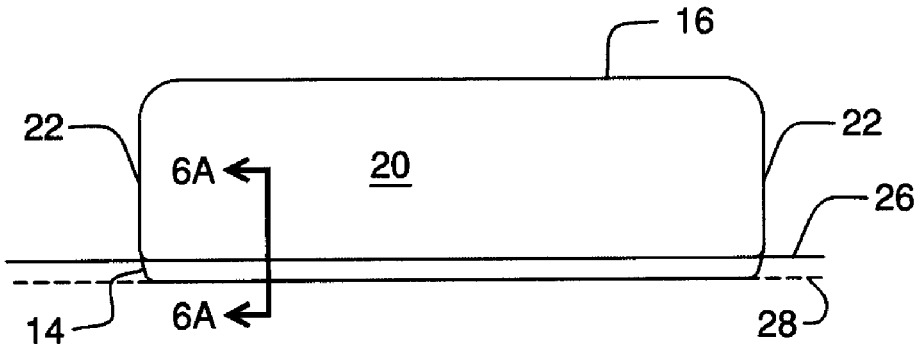
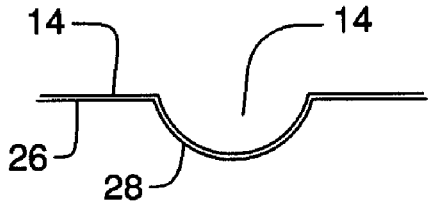
FIG. 6A

GROUT CLEANING SPONGE

BACKGROUND OF INVENTION

1. Field of the Invention

This invention relates, generally, to tools used for cleaning tiles. More particularly, it relates to a sponge having utility for cleaning the grout between tiles.

2. Description of the Prior Art

Tiled floors or other surfaces are common in households, office buildings, and the like. Those attempting to keep the tiles clean typically use conventional mops, sponges, and other common cleaning tools. However, the grout between the tiles is difficult to clean because it lies in elongate concavities between contiguous tiles. When a conventional sponge is used in an effort to clean the grout, the flat surfaces thereof do not conform well to the concavities. Accordingly, the cleaning of grout with a conventional sponge is problematic.

The solution to the identified problem was not obvious to those of ordinary skill in the tile cleaning industry in view of the prior art when considered as a whole at the time the present invention was made.

SUMMARY OF INVENTION

The long-standing but heretofore unfulfilled need for a sponge that cleans tiled surfaces, including the grout between contiguous tiles, is now met by a new, useful, and non-obvious invention.

The novel sponge includes a main body having a solid, generally parallelepiped structure that includes a flat top wall, a flat bottom wall, a pair of flat, longitudinally-extending side walls, and a pair of flat, transversely extending side walls.

A first plurality of longitudinally extending, parallel, convexities is formed in the flat bottom wall. Both the main body and the convexities are formed of a resilient, flexible material so that the convexities enter into and conform to the shape of the concavities when the sponge is used to clean the grout in the spaces between said tiles.

Each convexity of the first plurality of convexities has a first, predetermined height relative to the flat bottom surface, and each concavity formed by each strip of grout has a predetermined depth. The first, predetermined height of the convexities slightly exceeds the predetermined depth of the concavities.

In a second embodiment, a second plurality of longitudinally extending, parallel convexities are formed in the flat bottom wall. Each convexity of said second plurality of convexities has a height dimension less than the first, predetermined height of the convexities of said first plurality of convexities.

The convexities of the second plurality of convexities are also formed of a resilient, flexible material so that said convexities enter into and conform to the concavities between tiles when the sponge is in use.

The sponge is preferably formed of a reticulated polyester having a density of about 1.6 to 2.0 pounds per cubic foot.

The sponge may be adapted to be releasably attached to a distal end of an elongate handle.

In a third embodiment, a plurality of curvilinear convexities are formed in the flat bottom wall of the sponge. The curvilinear convexities are formed of a resilient, flexible material so that they enter into and conform to the shape of the concavities when the sponge is used.

BRIEF DESCRIPTION OF DRAWINGS

For a fuller understanding of the nature and objects of the invention, reference should be made to the following detailed description, taken in connection with the accompanying drawings, in which:

FIG. 6 is a side elevational view depicting the novel sponge in vertical relation to a plurality of installed tiles;

FIG. 6A is a sectional view taken along line 6A—6A in FIG. 6;

DETAILED DESCRIPTION

Figure 1:
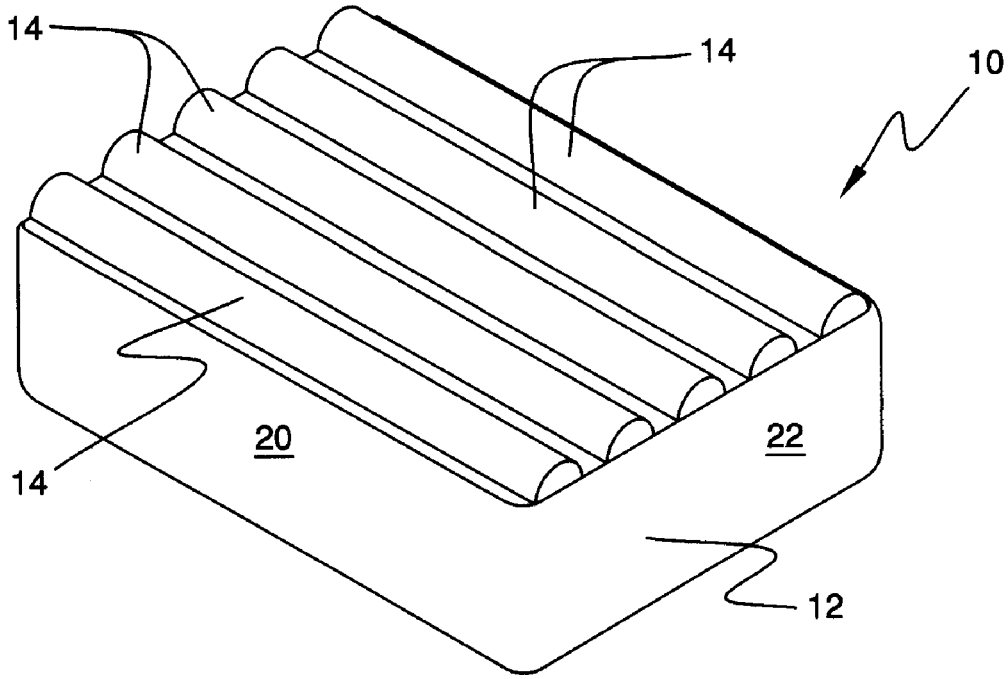
FIG. 1 is a perspective view of a preferred embodiment of the invention.
Figure 2:
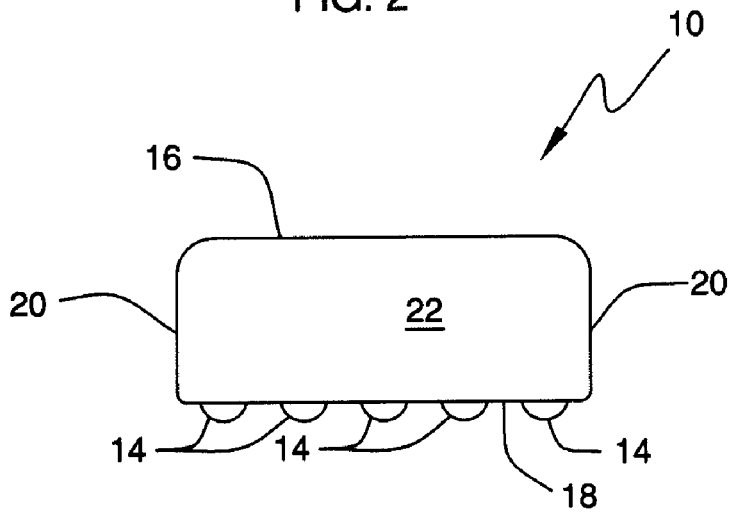
FIG. 2 is an end elevational view thereof.

Referring now to FIGS. 1 and 2, it will there be seen that an illustrative embodiment of the invention is denoted as a whole by the reference numeral 10.

Sponge 10 includes main body 12 having a generally solid, parallelepiped structure and a plurality of linear-in-configuration convexities, collectively denoted 14, disposed in parallel, spaced apart relation to one another. Convexities 14 are preferably formed integrally with main body 12 when sponge 10 is molded. The preferred material from which sponge 10 is molded is reticulated polyester, but other suitable sponge or sponge-like material is within the scope of this invention. The preferred density of the reticulated polyester is 1.6 to 2.0 pounds per square foot.

More particularly, sponge main body 12 includes flat top wall 16, flat bottom wall 18, longitudinally-extending side walls 20, and transversely-extending side walls 22.

Figure 3:
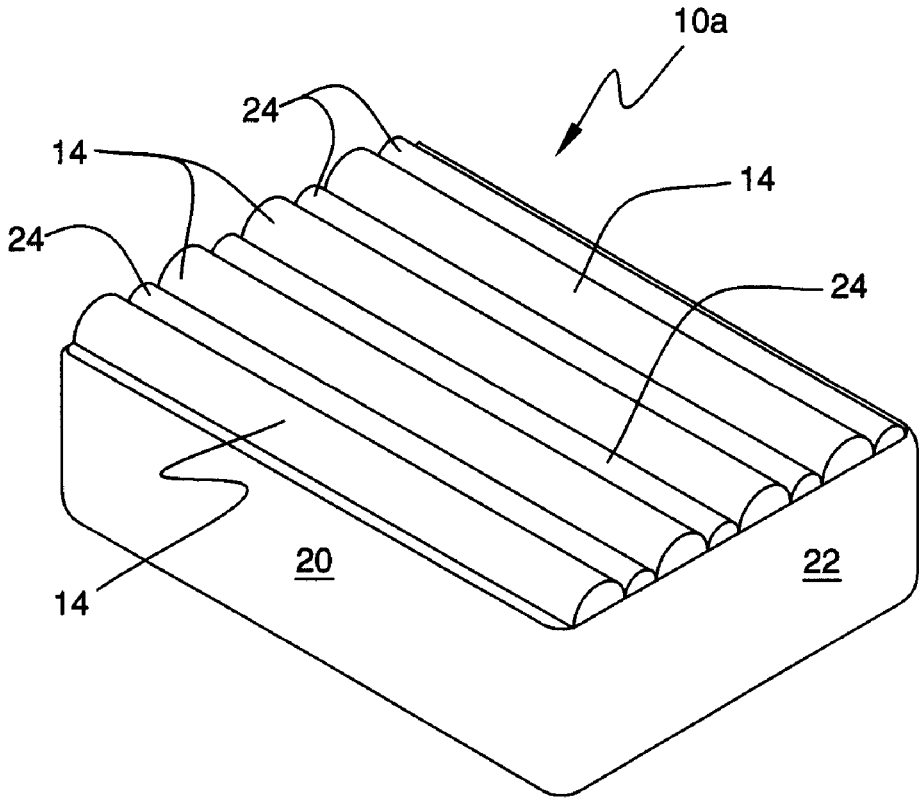
FIG. 3 is a bottom perspective view of the second embodiment.
Figure 4:
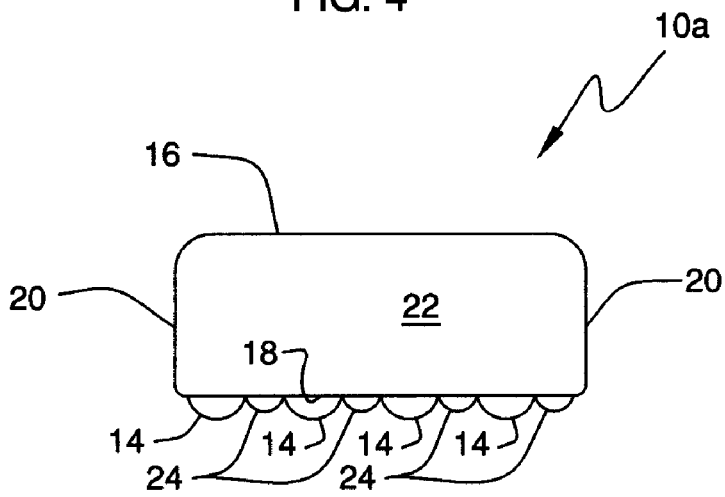
FIG. 4 is an end elevational view of a second embodiment.

A second embodiment, denoted 10*a* as a whole, is depicted in FIGS. 3 and 4. In this embodiment, each empty space between primary convexities 14 in the first embodiment is occupied by a secondary convexity, collectively denoted 24, having less height than that of primary convexities 14. As illustrated, each secondary convexity may also have less width than a primary convexity. However, in an unillustrated embodiment, each secondary convexity has a width substantially equal to that of each primary convexity.

Figure 5:
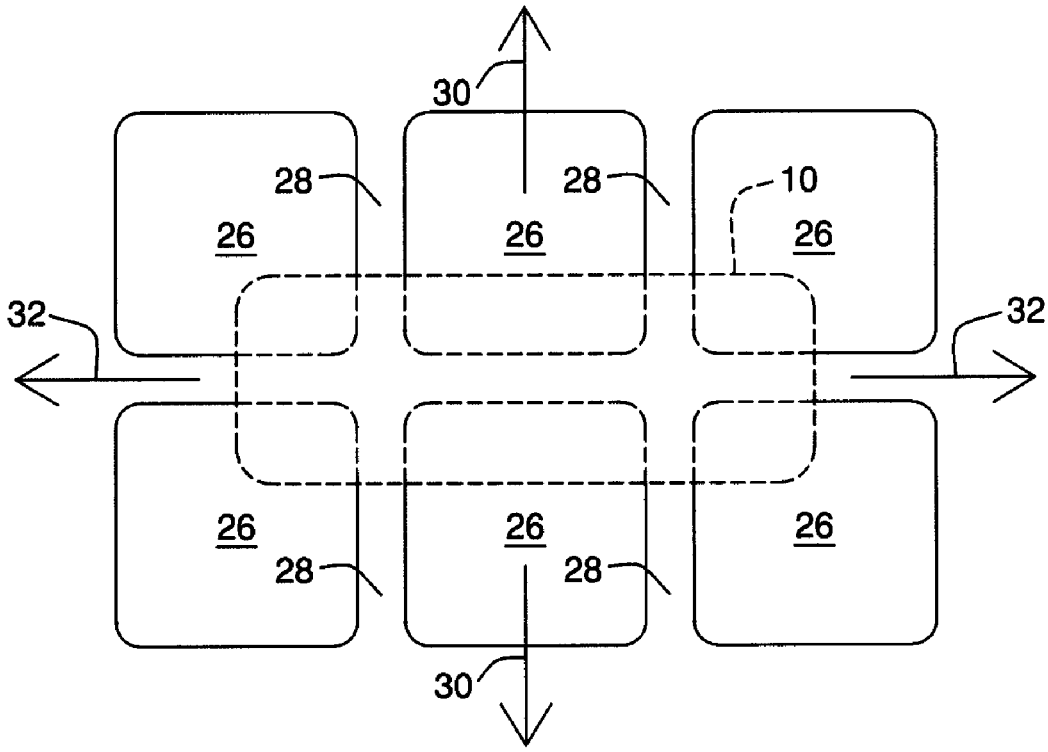
FIG. 5 is a top plan view depicting the embodiment of FIG. 1 disposed in overlying relation to a plurality of installed tiles.

FIG. 5 depicts the novel sponge when positioned atop a plurality of installed tiles, collectively denoted 26, that are separated from one another by concave strips of grout, collectively denoted 28. To clean dirt from the grout, sponge 10 may be pushed back and forth as indicated by directional arrows 30, 30 or to the left and right as indicated by directional arrows 32, 32.

As best understood in connection with FIG. 6, the flexible and resilient construction of convexities 14 enables each convexity 14 to deform, conforming to the shape of concavities 28, regardless of which direction sponge 10 is oscillated. Since tiles 26 are normally laid in a grid-like fashion, convexities 14 will be parallel to a first plurality of grout channels 28 and perpendicular to a second plurality of said grout channels. The invention has utility with tiles laid in any configuration, i.e., it is not limited to tiles laid in a rectangular grid as illustrated.

Figure 7:
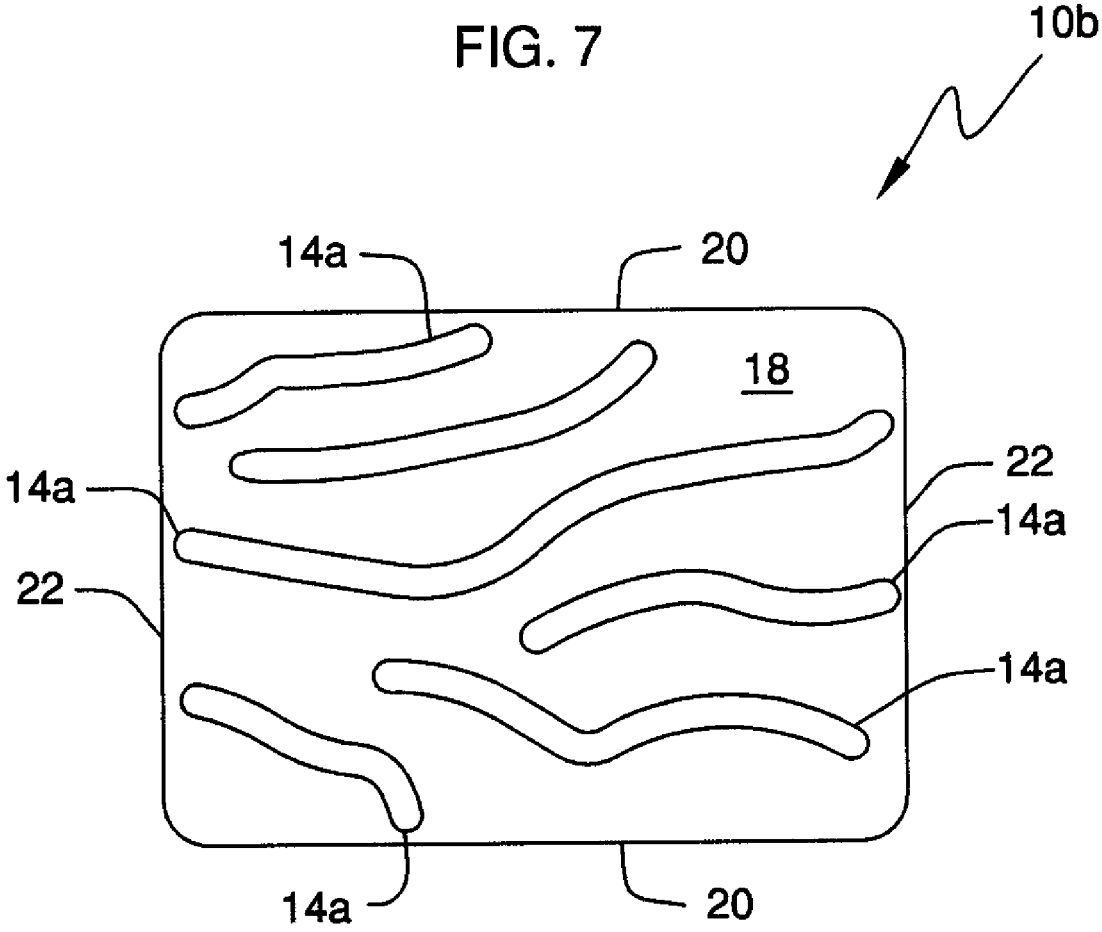
FIG. 7 is a bottom plan view of a third embodiment where each convexity is nonlinear in configuration.

Nor must primary convexities 14 (or secondary convexities 24) be linear in configuration and parallel to one another. Thus, an embodiment such as that depicted in FIG. 7 is within the scope of this invention.

Figure 8:
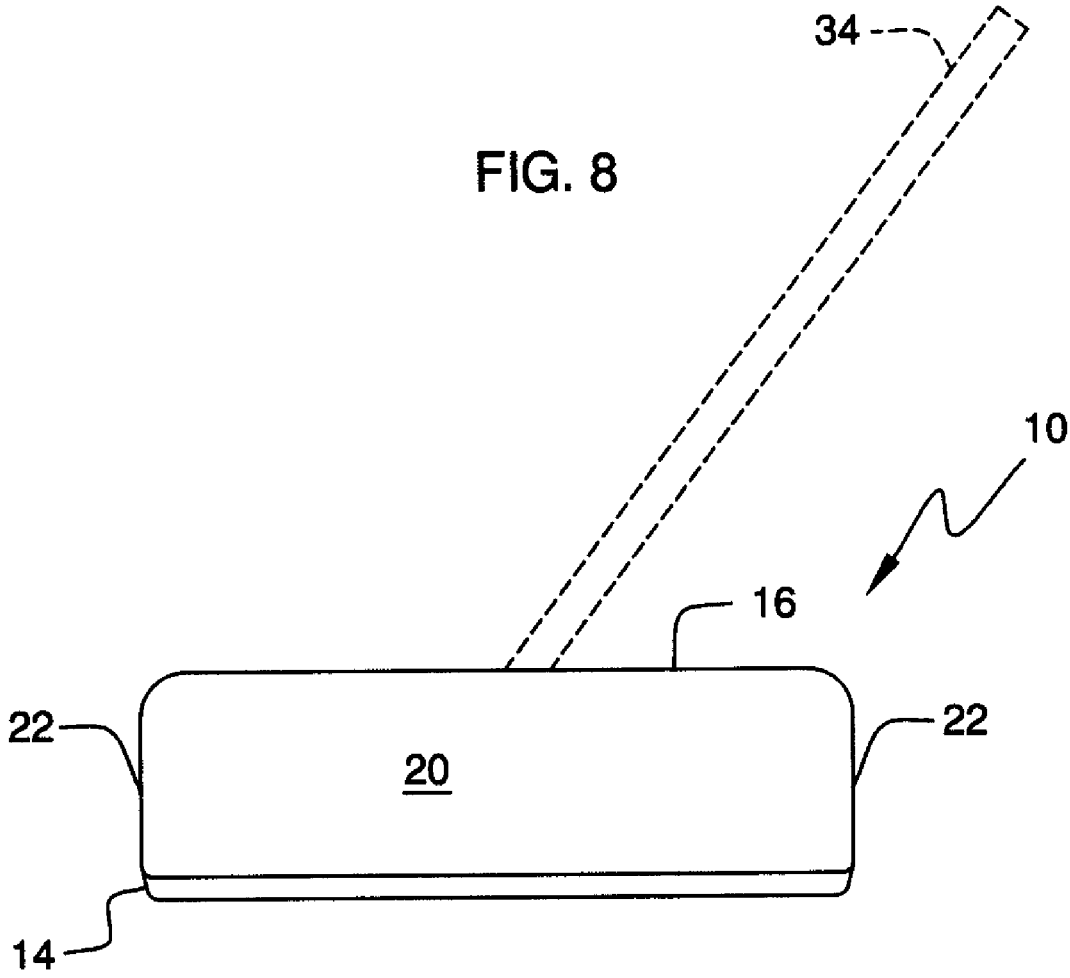
FIG. 8 is a side elevational view of an embodiment where the novel sponge is secured to the end of a mop handle.

Sponge 10 may be hand-held or in may be mounted to the end of a mop handle such as mop handle 34 in FIG. 8.

It should be noted that although the novel sponge has utility in cleaning grout between tiled surfaces, it may be used in many other applications as well.

It will thus be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described,

The invention claimed is:

1. A sponge adapted to clean grout in a tile surface that includes a plurality of tiles disposed in spaced apart relation to one another, and having a strip of grout disposed between contiguous tiles, each strip of grout forming an elongate concavity relative to the respective surfaces of the tiles, comprising:

a main body having a solid, generally parallelepiped structure that includes a flat top wall, a flat bottom wall, a pair of flat, longitudinally-extending side walls, and a pair of flat, transversely extending side walls;

a first plurality of longitudinally extending, parallel convexities formed in said flat bottom wall;

said main body and said convexities being formed of a resilient, flexible material;

said convexities entering into and conforming to said elongate concavities when said sponge is in use;

each convexity of said first plurality of convexities having a first predetermined height relative to said flat bottom surface;

each elongate concavity formed by each strip of grout having a predetermined depth;

said first predetermined height slightly exceeding said predetermined depth;

a second plurality of longitudinally extending, parallel convexities formed in said flat bottom wall;

each convexity of said second plurality of convexities having a second predetermined height less than said first predetermined height of said convexities of said first plurality of convexities;

said convexities of said second plurality of convexities being formed of a resilient, flexible material;

said convexities of said second plurality of convexities entering into and conforming to said elongate concavities when said sponge is in use;

whereby said sponge is adapted to clean grout between tiles.

* * * * *